United States Patent [19]

Keller et al.

[11] 4,129,843

[45] Dec. 12, 1978

[54] MAGNETIC TRIP MEANS FOR CIRCUIT BREAKER

[75] Inventors: Frank R. Keller, Villanova; John B. Cataldo, Lansdale, both of Pa.; Frank W. Kussy, Randallstown, Md.; Bernard DiMarco, Bellefontaine, Ohio

[73] Assignee: I-T-E Imperial Corporation, Spring House, Pa.

[21] Appl. No.: 729,699

[22] Filed: Oct. 5, 1976

[51] Int. Cl.[2] ..... H01H 9/00

[52] U.S. Cl. ..... 335/174; 335/176

[58] Field of Search ..... 335/174, 175, 176, 170, 335/257, 258, 260, 38, 39, 59, 63

[56] References Cited

U.S. PATENT DOCUMENTS

| | | | |
|---|---|---|---|
| 2,690,528 | 9/1954 | Wilckens | 335/39 X |
| 2,700,711 | 1/1955 | Wilckens | 335/39 X |
| 3,081,387 | 3/1963 | Smith | 335/39 |
| 3,226,605 | 12/1965 | Wright et al. | 335/257 X |
| 3,307,130 | 2/1967 | Camp | 335/258 X |
| 3,517,357 | 6/1970 | Bakes | 335/63 |

*Primary Examiner*—George Harris
*Attorney, Agent, or Firm*—Ostrolenk, Faber, Gerb & Soffen

[57] ABSTRACT

A magnetic trip means for automatically opening a circuit breaker contact upon the occurrence of predetermined fault current conditions is constructed of a stationary yoke, an armature biased away from the yoke and movable toward the yoke for tripping of the switch, an actuating coil in series with the contacts, and a sealed capsule coaxial with the coil for obtaining selected tripping characteristics. Within the sealed capsule there is a movable magnetic core biased to a normal position extending substantially outside the coil. The core is movable inside of the coil toward the armature upon the occurrence of overload current conditions with movements of the core toward the armature being retarded in a controlled manner. Control is obtained by closely spacing the outer cylindrical wall of the core and the inner cylindrical wall of the capsule, and additionally by utilizing a viscous fluid within the capsule. For a given overload current, as the core moves closer to the armature there is an increased force acting to move the armature toward tripping position.

9 Claims, 5 Drawing Figures

MAGNETIC TRIP MEANS FOR CIRCUIT BREAKER

This invention relates to automatic electric switching devices and more particularly relates to a dual element magnetic means for automatic tripping upon the occurrence of predetermined overload currents.

Conventional circuit breaker automatic magnetic trip devices sensitive to predetermined overload conditions are usually constructed with an armature biased to a normal or non-tripping position. Upon the occurrence of predetermined fault current conditions, the fault current flowing through a sensing coil generates a magnetic flux which establishes a force field that moves the armature to trip the circuit breaker.

The current-trip time characteristic of the conventional magnetic trip means may be changed by adjusting the biasing force acting on the armature. However, the shape of the current-time characteristic curve will not change unless the so called normal or non-tripping position of the armature is also changed. This is undesirable in that it is difficult to control the shape of the curve by varying the armature position and in order to appreciably change the shape of the curve there must be a substantial change in the position of the armature.

Thus, in accordance with the instant invention an automatic magnetic trip means is constructed with an armature biased to a normal position remote from a sensing coil which is wound around a sealed capsule having a magnetic core movably mounted therein and biased away from the armature to a normal position extending outside of the coil. Upon the occurrence of predetermined overload conditions magnetic flux generated by current flowing in the coil draws the core into the coil toward the armature. As the core moves toward the armature magnetic forces acting on the armature increase until a point is reached where the armature biasing force is overcome thereby permitting the armature to move rapidly toward its tripping position.

The shape of the current-trip time characteristic of the device constructed in accordance with the instant invention may be changed in a controlled manner in accordance with the construction of the sealed capsule. That is, the desired trip characteristic is obtained by retarding movement of the core toward the armature. This is done by controlling the closeness of spacing between the outer cylindrical wall of the core and the inner cylindrical wall of the capsule and by having the capsule filled with a viscous fluid. In order to facilitate changing the shape of the current-trip time characteristic, the sealed capsule may be part of a removable and replaceable sub-assembly similar to that disclosed in the F. W. Kussy et al copending application Ser. No. 681,243 filed Apr. 28, 1976 issued May 9, 1978 as U.S. Pat. No. 4,088,973, for a UNITIZED COMBINATION STARTER, and assigned to the assignee of the instant invention.

Accordingly, a primary object of the instant invention is to provide an improved construction for a magnetic trip means of a circuit breaker.

Another object is to provide a magnetic trip means constructed so that the shape of its current-trip time characteristic may be changed in a controlled manner.

Still another object is to provide a magnetic trip means of this type having two movable elements biased away from each other by individual biasing means.

A further object is to provide magnetic trip means of this type including a sealed capsule having a closely fitted magnetic core movably mounted therein with movement controlled by closeness of the fitting between the core and the interior wall of the capsule, and also by the characteristic of fluid within the capsule.

These objects as well as other objects of this invention shall become readily apparent after reading the following description of the accompanying drawing in which.

Figure 1:
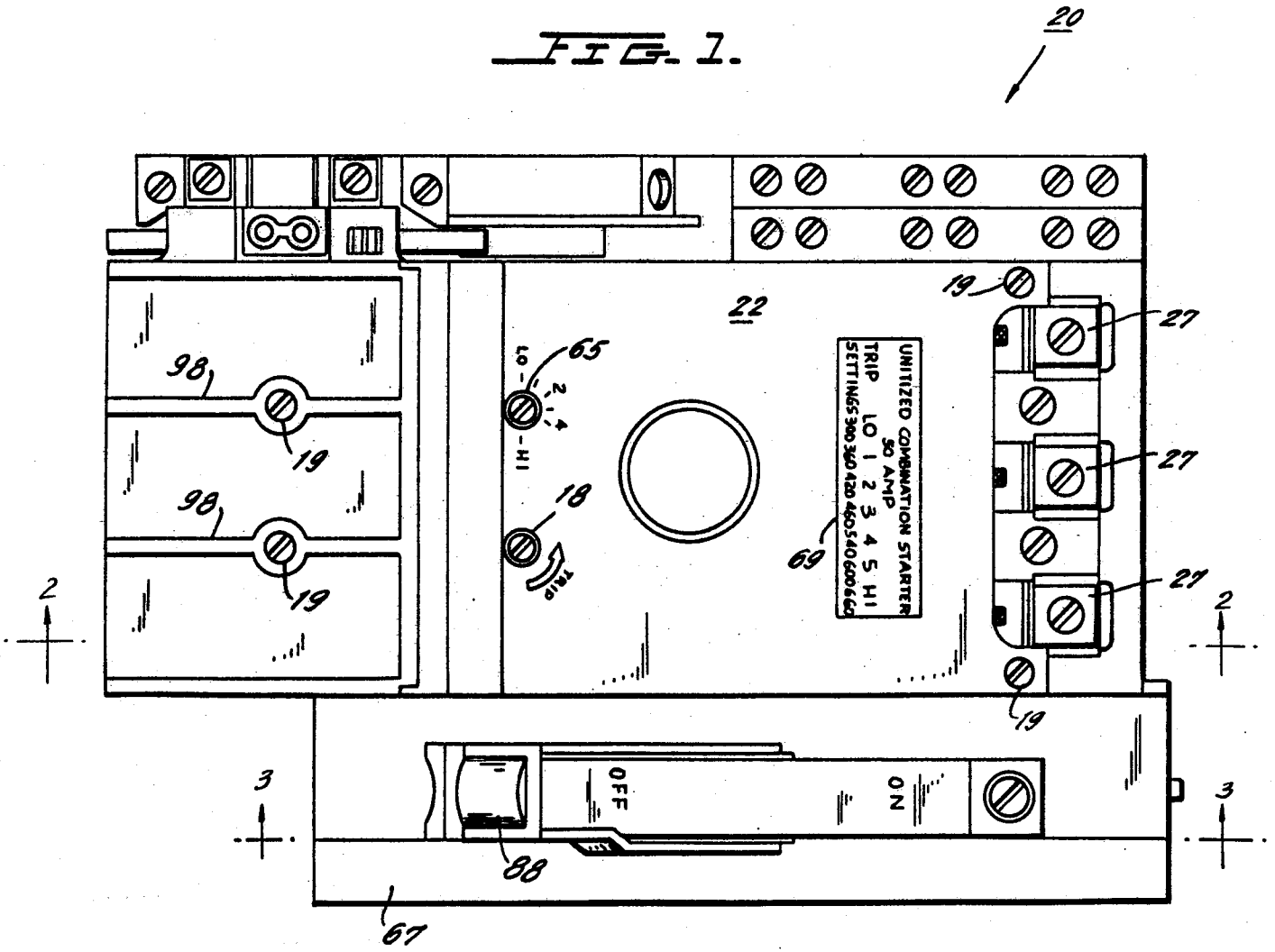
FIG. 1 is a plan view of a switching device including magnetic automatic trip means constructed in accordance with teachings of the instant invention.

Now referring to the Figures. Unitized combination motor starter 20 includes a molded insulating housing consisting of base 21 and removable shallow front cover 22 secured in operative position by screws 19. Screw 212 secures mounting plate 213 in recess 214 at the rear of base 21. Cover 22 includes longitudinally extending parallel ribs that mate with similar ribs in base 21 to form elongated parallel compartments that extend from left to right with respect to FIG. 1. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 3.

Figure 2:
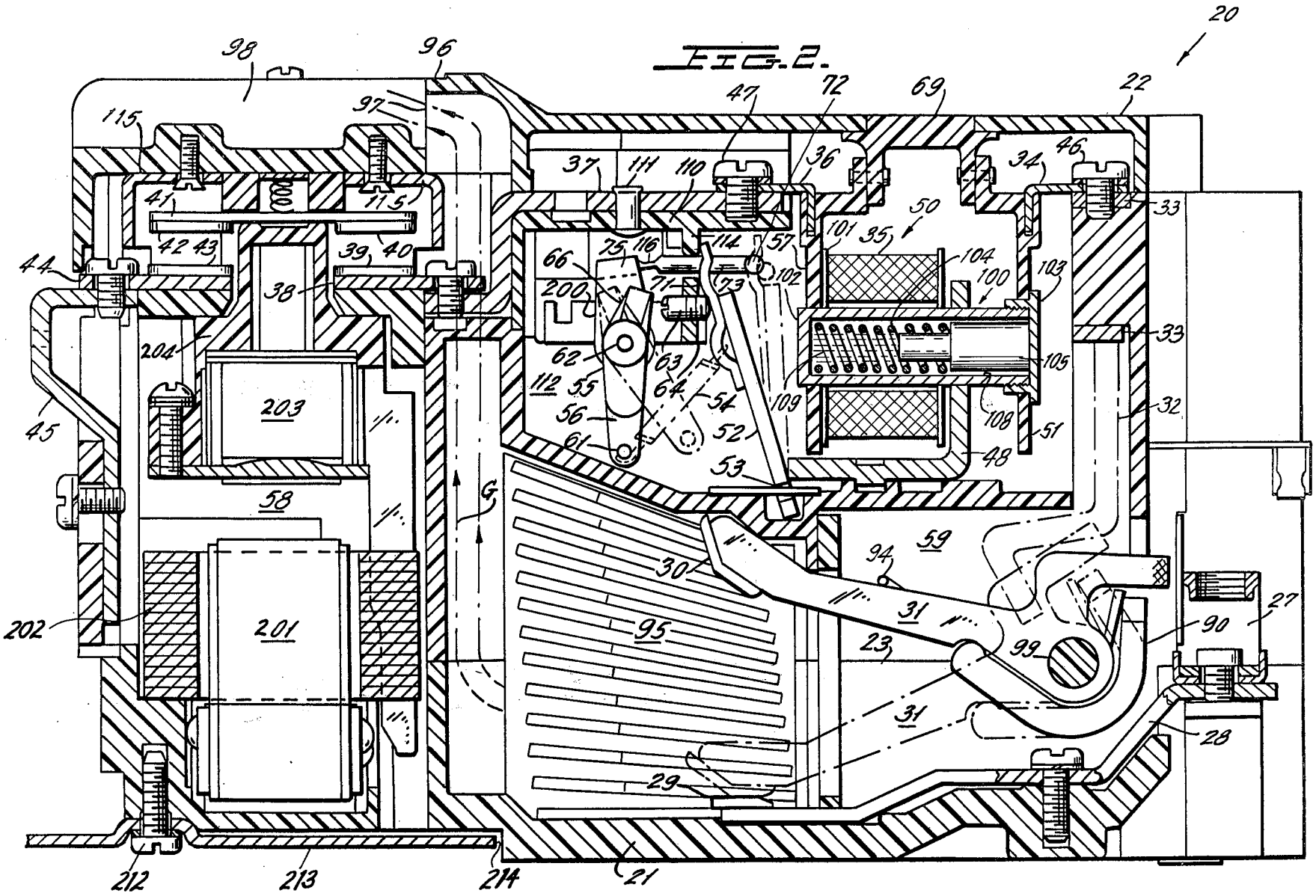
FIG. 2 is a cross-section through one pole of the switching device of FIG. 1 looking in the direction of arrows 2, 2 of FIG. 1.
Figure 3:
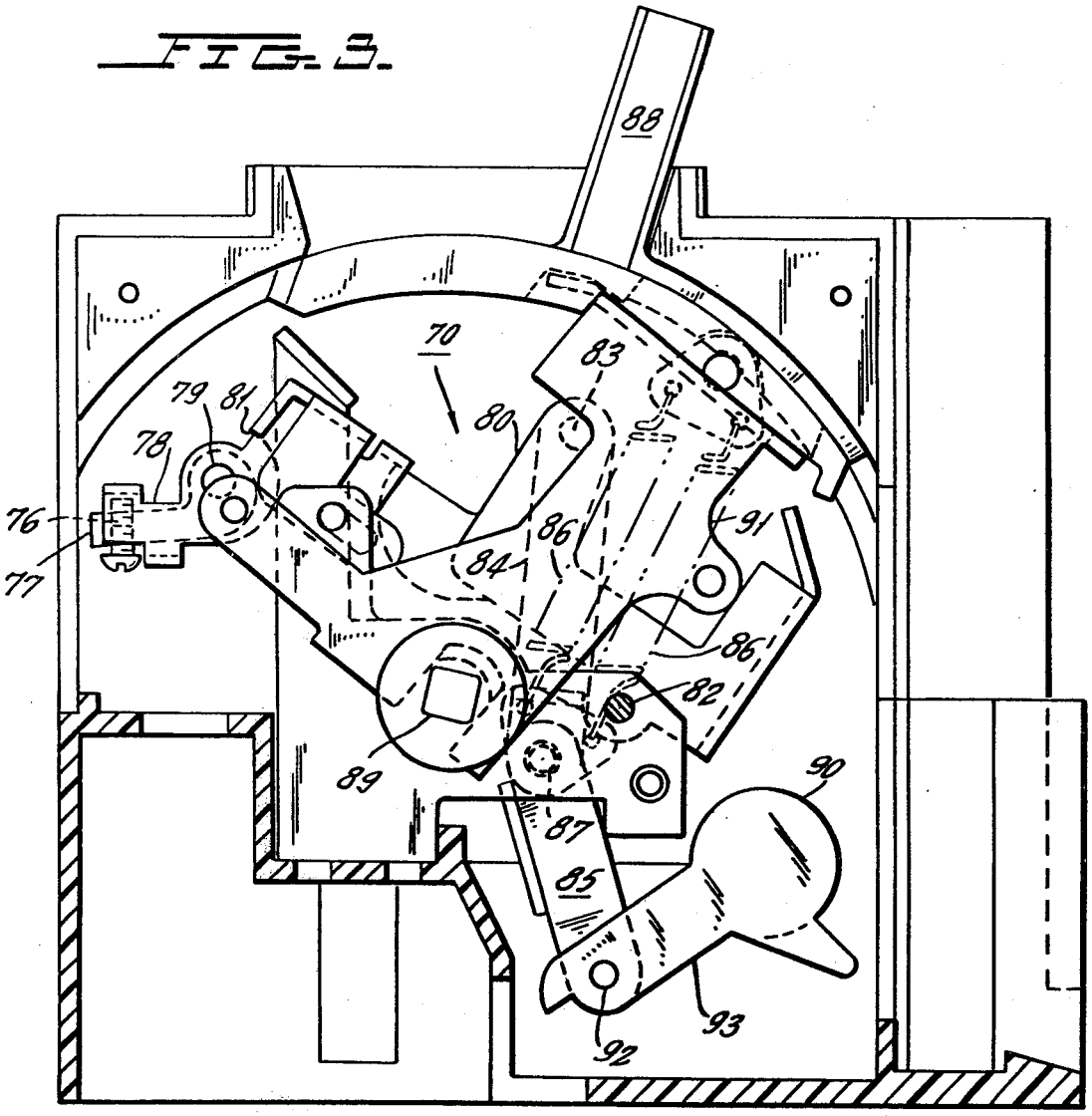
FIG. 3 is a cross-section taken through line 3—3 of FIG. 1 looking in the direction or arrows 3, 3 showing the elements of the circuit breaker contact operating mechanism in contact closed position.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 101 cemented to insulator 57 having coil terminal 36 mounted thereto. Insulator 51 parallel to insulator 57 mounts coil terminal 34. Subassembly 50 also includes L-shaped stationary magnetic yoke 48 and capsule unit 100. The latter includes sealed thin wall non magnetic cylindrical capsule 102 having cap 103 screwed to one end thereof. A fluid seal (not shown) is interposed between capsule 102 and its cap 103. Disposed within capsule 102 are cylindrical magnetic core 105 and coiled compression spring 104 which biases core 105 to its normal position shown abutting the end of capsule 102 remote from armature 52. Viscous fluid 109 within capsule 102 retards movement of core 105. Capsule 102 is coaxial with coil 35 and is frictionally held in aligned apertures of yoke 48 and insulators 51, 57. Yoke 48 and core 105 are parts of a magnetic frame that also includes movable armature 52 pivotally mounted at its lower end in the region indicated by reference nemeral 53 so that the upper end of armature 52 may move toward and away from core 105.

Coiled tension spring 54 is connected to pin formation 61 at the free edge of radial extension 56 on adjusting bar 55. The latter is pivoted on pins 62 so that spring 54 biases the upper end of armature 52 away from core 105. The air gap adjustment between armature 52 and core 105 is set by screw 63 which is threadably mounted to transverse member 64. A cam (not shown) at the rear of pivotable adjusting control 65 engages extension 66 of member 55 to adjust simultaneously the tension on springs 54 of all three poles without changing the air gaps between any of the armatures 52 and their associated coils 35. Control 65 extends through and is journalled for movement within an aperture of auxiliary cover 110 and turn-to-trip control 18 extends through and is journalled for movement within another aperture of auxiliary cover 110. Both controls 65 and 18 are accessible for operation through apertures in main cover 22.

In a manner to be hereinafter described, upon the occurrence of predetermined fault current conditions the flux generated by current flowing in coil 35 attracts armature 52 to stationary core 105 causing bifurcated armature extension 71 to engage enlarged formation 72 on transverse extension 73 of common tripper bar 75. This pivots the latter clockwise about an axis which coincides with axis 62 for adjusting bar 55 which causes screw 76 (FIG. 3) on tripper bar extension 77 to pivot latch member 78 in a clockwise or direction about its pivot 79, thereby releasing latching point 81 of cradle 80 so that the latter is free to pivot counterclockwise about pivot 82. As cradle 80 pivots counterclockwise, end 83 of upper toggle link 84 moves to the left with respect to FIG. 3 until end 83 moves to the other side of the center line for lower toggle link 85. Now coiled tension spring 86, connected between toggle knee 87 and manual operating handle 88, collapses toggle 84, 85 and handle 88 is pivoted about center 89 through a connection between handle 88 and its rearward extension 91.

The lower end of lower toggle link 85 is pivotally connected at 92 to the free end of radial extension 93 of contact carrier 90. This causes carrier 90 to pivot clockwise with respect to FIG. 3 and by so doing moves the contact arms 31 of all three poles to the solid line or open circuit position of FIG. 2. It is noted that in the closed position of circuit breaker portion 59 an individual torsion spring 94, interposed between carrier 90 and movable contact arm 31, biases arm 31 counterclockwise about insulating rod 99 as a center and thereby generates contact pressure.

For each pole of circuit breaker portion 59 an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 201 whose arms are surrounded by portions of coil 202. When the latter is energized, armature 203 is attracted to yoke 201 and carries contact carrier 204 rearward. The latter mounts the bridging contacts 41 of all three poles so that contacts 41 move to their closed position wherein movable contacts 40, 42 engage the respective stationary contacts 39, 43. Steel elements 115 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted to trip bar 75 at resilient reduced cross-section area 116 which is constructed to bias extension 73 forward. It is noted that base 21 is a multipart unit having sections which mate along dividing line 23 so that the reduced diameter bearing portions of contact carrier 90 may be inserted and captured in operative positions.

The magnetic automatic trip means including assembly 50 is a dual element device in that both core 105 and armature 52 move under the influence of magnetic flux generated by current in coil 35. When a fault condition exists causing this current to exceed predetermined limits, at a low fault core 105 moves to the left through the center of coil 35 and toward armature 52. This movement of core 105 is retarded because viscous fluid 109 has only the narrow space 108 between core 105 and cylinder 102 through which to flow to the right side of core 105. However, when the gap between core 105 and armature 52 becomes sufficiently small, the magnetic force acting on armature 52 urging it to pivot clockwise is sufficient to move armature 52 clockwise, thereby pivoting trip bar 75 clockwise and releasing spring powered over-center toggle contact operating mechanism 70 to separate operating contacts 29, 30. At very high fault currents, armature 52 will pivot to tripping position before there is substantial movement of core 105.

Figure 4:
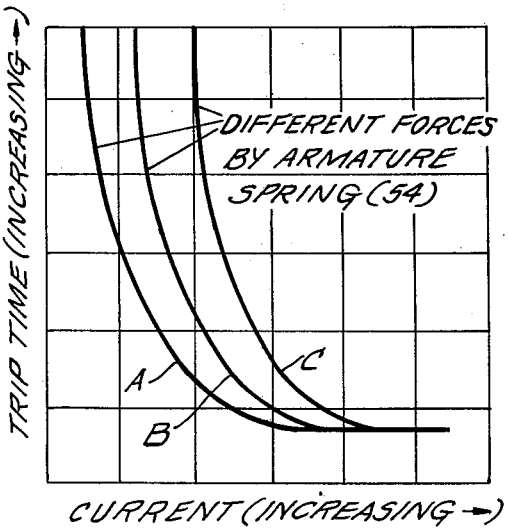
FIG. 4 is a family of curves illustrating the current-trip time characteristic of a prior art magnetic trip means.
Figure 5:
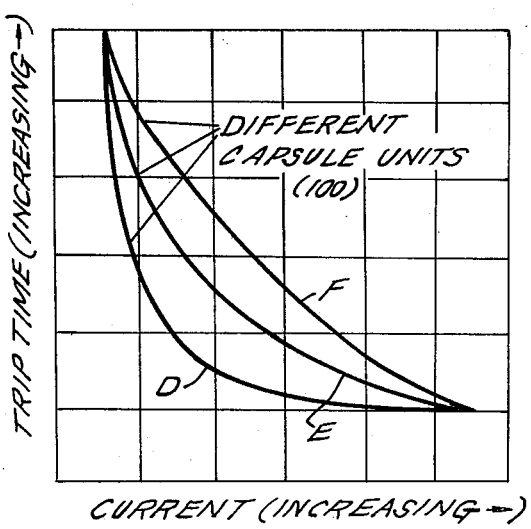
FIG. 5 is a family of curves illustrating the current-trip time characteristic of a magnetic trip means constructed in accordance with teachings of the instant invention.

FIG. 4 illustrates a family of curves showing that even though the current-trip time characteristic of the magnetic trip means may be changed by changing the armature spring force by operating control 65, the shape of the curve remains essentially unchanged. In FIG. 4 curve A is the characteristic when spring 54 is adjusted to exert a spring force that is less than the spring forces which result in curves B and C. The characteristic of curve C is obtained when the force exerted by spring 54 is greater than the spring forces to obtain curves A and B. However, as seen in FIG. 5, by utilizing an assembly 50 having a different capsule unit 100 the shape of the current-trip time characteristic is changed. In particular, the characteristic D is produced by retarding movement of core 105 less than movement of core 105 is retarded to produce either characteristics E or F. Characteristic F is produced by retarding movement of core 105 to a greater extent than this movement is retarded when characteristics D and E are produced. The retarding force, or dashpot effect, on core 105 is controlled by the thickness of space 108 and the viscosity of fluid 109.

Utilization of sealed capsule unit 100 enables the magnetic tripping means to be designed in such a way that it is capable of meeting the essential characteristics of an overload relay (time delay at motor running overload conditions) and at the same trip instantaneously at fault currents higher than running overloads, thereby affording branch circuit protection. By eliminating the overload relay there is a considerable saving of space. Further, the device is more reliable in that magnet energizing coil 35 is much less likely to be damaged by short circuit currents than is the heater coil of an overload relay.

For more detailed descriptions of certain elements illustrated in the drawings reference is made to one or more of the following co-pending U.S. Patent applications Ser. Nos. 681,243 (now U.S. Pat. No. 4,088,975 issued May 9, 1978), 681,245 (now U.S. Pat. No. 4,066,989 issued Jan. 3, 1978), 681,250 (now U.S. Pat. No. 4,087,769 issued May 2, 1978), 681,253 (now U.S. Pat. No. 4,095,675 issued June 13, 1978), 681,244 (now U.S. Pat. No. 4,068,200 issued Jan. 10, 1978), all filed on Apr. 28, 1976.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. An electrical switching device including separable switch contact means; a spring powered operating means connected to said switch contact means for opening and closing thereof; an overload device operatively connected to said spring powered operating mechanism; housing means wherein said contact means, said operating means and said overload device are disposed; said housing means including a front opening normally closed by removable cover means; said housing means having means at the rear thereof for operatively securing said switching device in front of a support surface; said overload device upon sensing predetermined overload conditions in circuit with said switching device automatically actuating said spring powered operating mechanism to open said switch contact means; said overload device including a sensing coil in series circuit with the contact means, a stationary magnetic yoke, and a magnetic armature biased away from said yoke and mounted for movement toward said yoke to actuate said spring powered mechanism; said overload device also including additional magnetic means comprising a movable magnetic core coaxial with said coil, projecting out the end of said coil remote from said armature, biasing means urging said core away from said aperture, and additional means for retarding movement of said core into said coil and toward said armature in a controlled manner upon energization of said coil by overload currents; said coil, said yoke and said additional magnetic means being parts of a sub-assembly that is removable and replaceable through said front opening to change the calibration range of the switching device while the armature remains operatively mounted within said housing means as part of the switching device and while said device remains secured to a support surface adjacent the rear of said device.

2. An electrical switching device as set forth in claim 1 in which the biasing means for the core and biasing means for the armature are so proportioned that under conditions of low overload the core moves toward the armature before the armature moves toward the yoke.

3. An electrical switching device as set forth in claim 1 in which the additional means includes a sealed capsule having a chamber wherein the core and its said biasing means are disposed.

4. An electrical switching device as set forth in claim 3 in which there is a liquid pool within the chamber to retard rate of movement of the core toward the armature.

5. An electrical switching device as set forth in claim 4 in which the chamber is cylindrical and is coaxial with the core, and the outside of the core is closely spaced in relation to the inside cylindrical surface of the chamber.

6. An electrical switching device as set forth in claim 4 in which the biasing means for the core and biasing means for the armature are so proportioned that under conditions of low overload the core moves toward the armature before the armature moves toward the yoke.

7. An electrical switching device as set forth in claim 1 in which the yoke includes an aperture through which the core travels in moving toward the armature from its normal position projecting out the end of the coil remote from the armature.

8. An electrical switching device as set forth in claim 2 in which the core in its said normal position projects partway into the coil.

9. An electrical switching device as set forth in claim 1 in which the cover means when closing said front opening blocking removal of said sub-assembly.

* * * * *